US006377776B1

(12) United States Patent
Orchard, II et al.

(10) Patent No.: US 6,377,776 B1
(45) Date of Patent: Apr. 23, 2002

(54) CAM CONTROL MECHANISM

(75) Inventors: James V. Orchard, II, Holley; David F. Cahill, Rochester, both of NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/579,550

(22) Filed: May 26, 2000

(51) Int. Cl.[7] ..... G03G 15/20
(52) U.S. Cl. ..... 399/328; 74/567; 100/168
(58) Field of Search ..... 399/328, 339, 399/332, 331; 100/47, 160, 168, 176; 74/567

(56) References Cited

FOREIGN PATENT DOCUMENTS

JP 5-188821 * 7/1993

* cited by examiner

*Primary Examiner*—Joan Pendegrass

(57) ABSTRACT

A mechanism for applying pressure load force in a reproduction apparatus fuser device having at least one heated fuser member and a pressure member in nip relation to permanently fix a marking particle image to a receiver member. The pressure load force applying mechanism includes a load cam selectively rotated about a drive shaft, the cam having a wide constant radius section to have a wide tolerance in the stopping position. A cam follower member is associated with the load cam. A force of the load cam is applied via the cam follower member. A control mechanism is provided for the load pressure applying mechanism. The control mechanism includes a raised section at each end of the constant radius section of the load cam to act as stops for the follower.

14 Claims, 3 Drawing Sheets

CAM CONTROL MECHANISM

CROSS-REFERENCE TO RELATED APPLICATION

Reference is made to the commonly assigned U.S. Patent Application, the respective disclosures of which being incorporated herein by reference:

U.S. patent application Ser. No. 09/580,185, filed on May 26, 2000, entitled "FUSER LOADING SYSTEM".

FIELD OF THE INVENTION

This invention relates in general to a mechanism for controlling cam actuation, and more particularly to a cam control mechanism wherein when the cam stops in the wrong position a switch associated with the control mechanism is deactuated.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser device for typical electrographic reproduction apparatus includes at least one heated roller, having an aluminum core and an elastomeric cover layer, and at least one pressure roller in nip relation with the heated roller. The fuser device rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member. In applying pressure to the fusing nip, the pressure must be held within a desired tolerance range in order to achieve adequate fusing without disrupting transport of the receiver member through the fuser device and without damaging the receiver member or the fuser device. Prior fuser devices have had difficulties in balancing these at-opposite requirements.

In order to accomplish proper pressure application in the fusing nip, a mechanism is fully described in the above-identified co-pending U.S. patent application Ser. No. 09/580,185, for applying pressure load force in a reproduction apparatus fuser device having at least one heated fuser member and a pressure member in nip relation to permanently fix a marking particle image to a receiver member. The pressure load force applying mechanism includes a load arm assembly rotatable about a fixed pivot axis to apply a pressure force to the pressure member, and a load cam selectively rotated about a drive shaft. A cam follower member is associated with the load cam, wherein upon rotation of the load arm assembly, a force of the load cam is applied via the cam follower member to the load arm assembly. A spring nest is formed as a part of the load arm assembly. The spring nest supports at least a heavy spring and a light spring. The cam follower member, upon movement under the influence of the load cam, compresses the nested light spring and the heavy spring at different travel positions of the cam follower for varying the pressure force on the pressure member.

For the described pressure applying mechanism, it was desired to minimize cost and maximize reliability. To do so, there were to be no critical adjustments and a minimum number of parts. It was, therefore, decided that only one switch should be used for producing control signals for the pressure control mechanism. Additionally, space constraints were placed on the size of the cam and motor. The pressure applying mechanism requires that the heavy and light springs be deflected an exact amount regardless of where the rotation of the load cam has stopped. The load cam has a large constant radius section to provide an exact deflection while allowing for switch and motor coast tolerances. In order to actuate the cam within the time allowed, the motor speed and gear set were chosen. With this gear set, the motor coasted when turned off, and a brake was needed to limit the motor coast. The cam follower needed to contain a low friction bearing so as to limit the drag on the motor and keep the motor small. Reliability of this mechanism has been less than generally acceptable. This is due to the fact that when a receiver member passes through the fuser rollers, the load arm will deflect slightly. Over long runs, the cam will rotate at an almost imperceptible rate, but eventually the follower will exit the constant radius section of the cam and fall off the high load.

The cause of the cam motion has been identified as being due to small tolerances in the parts that placed the follower off center of the cam pivot. The off center load causes a moment to be generated which attempts to rotate the cam. Generally, the moment was small enough to be resisted by the friction in the system. However, the holding friction in the ball bearing of the follower is small. As the pressure arm assembly pulsates with the passage of a receiver member through the fuser device, the fluctuating moment sometimes overcomes the friction in the mechanism and small movements ensue. Eventually, the cam will move far enough for the follower to exit the constant radius portion of the cam. Once the follower is on a rising section of the cam, the tangential force from the follower rapidly moves away from the cam pivot centerline, and the moment increases dramatically. This high torque causes the cam to rotate away from the desired position. The solution to this problem has been complicated because the moment applied to the cam was deemed to be inevitable with parts tolerances, and the follower needed to retain the ball bearing to keep motor torque low.

SUMMARY OF THE INVENTION

In view of the above, this invention is directed to A mechanism for applying pressure load force in a reproduction apparatus fuser device having at least one heated fuser member and a pressure member in nip relation to permanently fix a marking particle image to a receiver member. The pressure load force applying mechanism includes a load cam selectively rotated about a drive shaft, the cam having a wide constant radius section to have a wide tolerance in the stopping position. A cam follower member is associated with the load cam. A force of the load cam is applied via the cam follower member. A control mechanism is provided for the load pressure applying mechanism. The control mechanism includes a raised section at each end of the constant radius section of the load cam to act as stops for the follower.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
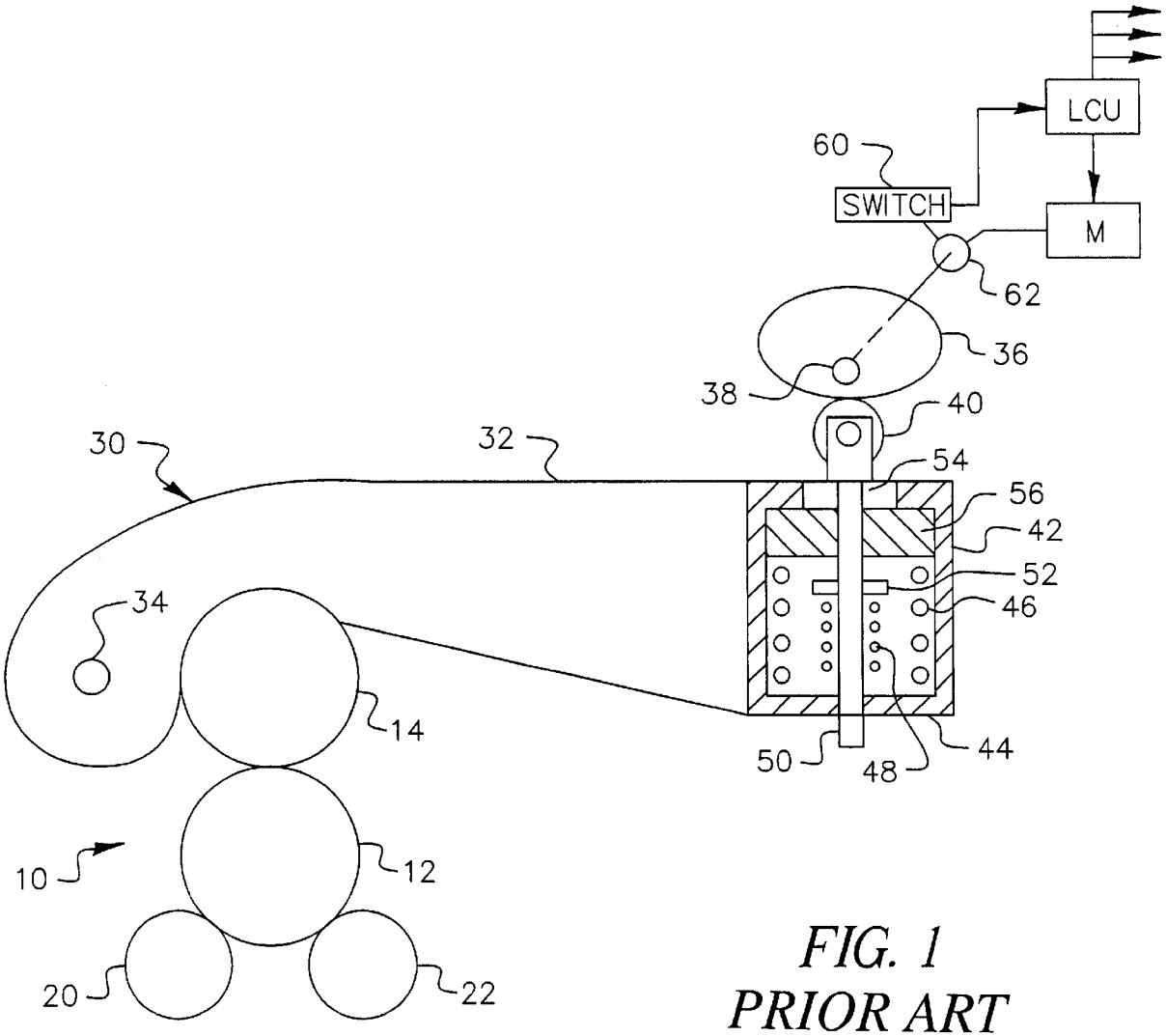
FIG. 1 PRIOR ART
FIG. 1 is a generally schematic side elevational view of a typical reproduction apparatus fuser assembly and a pressure loading control mechanism for such fuser assembly.
Figure 2:
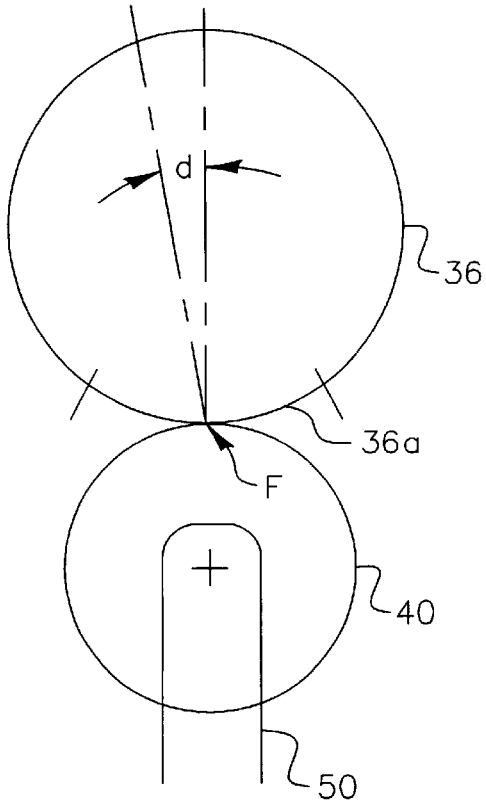
FIG. 2 is a generally schematic side elevational view of a portion of the pressure loading control mechanism of FIG. 1, showing the load cam and follower and the forces thereon under imperfect part conditions.

Referring now to the accompanying drawings, FIG. 1 shows a generally schematic side elevational view of a typical reproduction apparatus fuser assembly 10, controlled by a micro-processor based logic and control unit LCU, and the pressure loading control mechanism 30 for the fuser assembly. The fuser device 10 includes an elongated heated fuser roller 12 in nip relation with a pressure roller 14. Of course, this invention is suitable for use with other well-known fuser devices. Rotation of the fuser rollers by any suitable drive mechanism (not shown) will serve to transport a receiver member, bearing a marking particle image, through the nip under the application of heat and pressure. The heat source for the fuser roller 12 is a pair of external heater rollers, respectively designated by the numerals 20, 22, having internal heater lamps. The fuser roller is cradled between the two heater rollers 20, 22, and heat is applied to the fuser roller from the internally heated heater rollers. The heat will soften the marking particles of an image to be reproduced on receiver members, and the pressure will force the marking particles into intimate contact to be at least partially imbibed into the fibers at the surface of the receiver member material. Thus, when the marking particles cool, they are permanently fixed to the receiver member in an image-wise fashion.

The pressure load on the elongated fuser roller 12 is applied by the pressure roller 14. In turn, the pressure on the pressure roller 14 is applied by the pressure loading mechanism 30. The pressure loading mechanism 30, more fully described in the co-pending U.S. patent application Ser. No. 09/580,185, generally includes a load arm assembly 32 which is rotatable about a fixed pivot axis 34 to apply a downward force to the pressure roller 14. The rotational movement of the load arm assembly 32 about the pivot axis 34 is created by rotation of a load cam 36. The load cam 36 is rotated about a drive shaft 38 by any suitable motor M. The motor M is also controlled, for selective operation, by the reproduction apparatus micro-processor based logic and control unit LCU, which receives appropriate signals from a switch, designated by the numeral 60 in FIG. 1, associated with the load cam.

The downward force of the load cam 36 is applied via a cam follower member 40, through an elongated shaft 50 attached to the cam follower, to the load arm assembly 32. The load arm assembly 32 has a spring nest 42 formed as an integral part of the load arm assembly adjacent to one end thereof. A load plate 44 forms the floor of the spring nest and is located in juxtaposition with the lower portion of the load arm assembly 32. The load plate 44, which forms a guide for the shaft 50 as the shaft moves in a longitudinal direction under the influence of the load cam 40, supports a heavy spring 46 and a light spring 48. The springs 46 and 48 are helical compression springs, concentrically supported on the load plate 44 to surround the elongated shaft 50. The shaft 50 of the cam follower 40 additionally supports a light spring piston 52 and a shoulder feature 54. The light spring piston 52 engages (and acts on) the light spring 48, and the shoulder feature 54 is adapted to selectively contact (and acts on) a heavy spring piston 56 retained in the spring nest 42.

The cam follower 40, upon movement under the influence of the load cam 36, compresses the nested springs 46, 48 at different longitudinal travel positions. In the position shown in FIG. 1, only the light spring 48 has been somewhat compressed (by the light piston spring 52), and the load applied to the arm assembly 32 is only dependent upon the spring constant of the light spring 48. Upon further downward travel of the cam follower 40, the shoulder 54 engages the heavy spring piston 56 and compresses the heavy spring 46. The load plate 44 would then be acted upon by both the light spring 48 and the heavy spring 46, and the load applied to the arm assembly 32 is dependent upon the spring constant of the light spring and the heavy spring.

Figure 3:
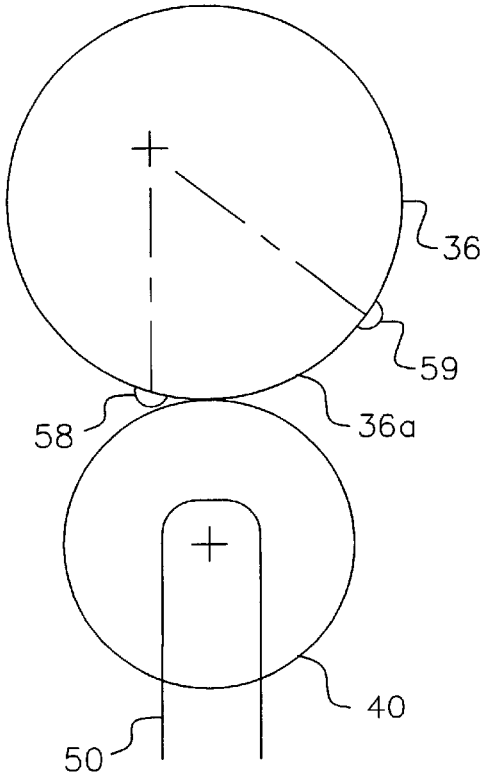
FIG. 3 is a generally schematic side elevational view of the portion of the pressure loading control mechanism, according to this invention, showing the load cam and follower with stops added to the load cam.

According to this invention, it is desired to provide accurate control over the rotation of the load cam 36, such that if the cam is not in the proper position, the switch 60 associated with the load cam to provide control signals for the logic and control unit LCU of the pressure loading control mechanism 30 produces a signal to deactuate the control mechanism. Accordingly, the wide constant radius section 36*a* of the cam 36 is selected to have a wide tolerance in the stopping position. A raised section 58, 59 (see FIG. 3) has been added to each end of the constant radius section 36*a* to act as a small stop. If the follower 40, due to back pressure from the heavy and light springs 46,48, causes the cam 36 to repeatedly move slightly about the axis 38, it would eventually encounter one of the stops 58, 59. The stops are selected to be sufficiently large to stop the movement of the follower 40 relative to the load cam 36, yet be small enough so that the motor M can readily rotate the load cam to move the stops over the follower.

A significant reason as to why raised sections 58, 59 are used as stops, as opposed to detents, is as follows. Detents are generally narrow and require stopping of the associated process. Some detents have slopes outside of the detent, which would cause the follower to create a moment so that the came rotates toward the center of the detent. When the follower is outside of the detent, it would necessarily deflect the springs in the spring nest an incorrect amount until the follower enters the bottom of the detent. Therefore, the slope in such a system would require that the slope be large enough to cause the cam to positively rotate so the follower enters the detent. This, in turn, would require that the motor be strong enough to enable the follower to later climb out of the detent. This would significantly increase the requirements of the motor so as to enable the motor to start while captured in a sizeable detent.

Figure 4:
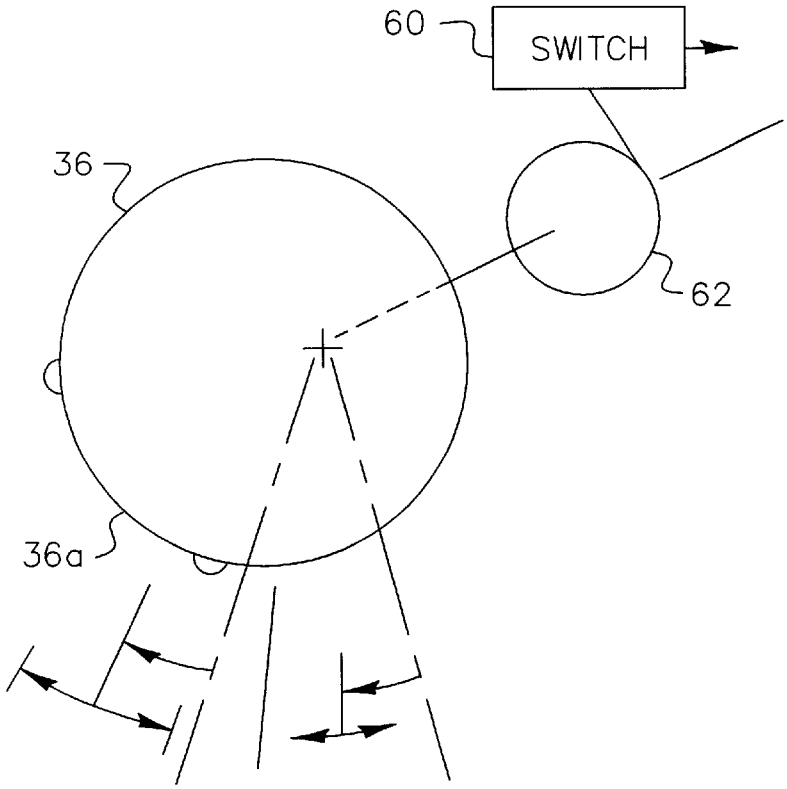
FIG. 4 is a generally schematic side elevational view of the load cam of the pressure loading control mechanism, particularly showing the effect of control switch tolerances.
Figure 5:
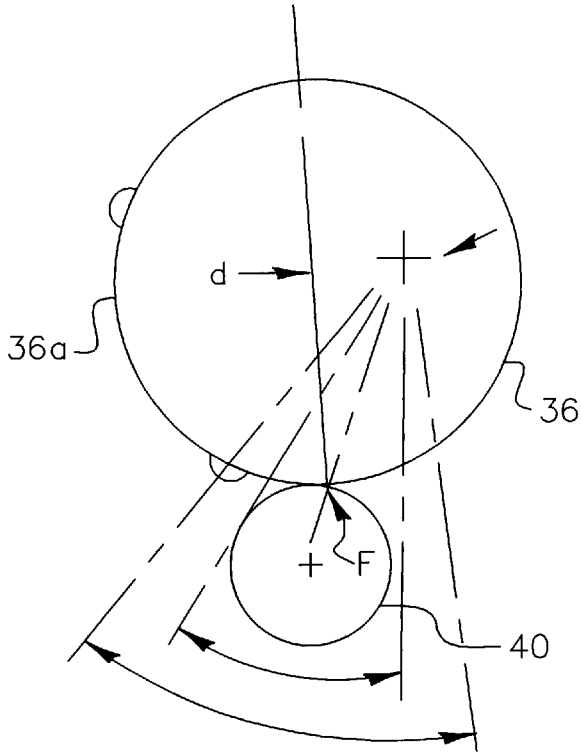
FIG. 5 is a generally schematic side elevational view of a portion of the pressure loading control mechanism, according to this invention showing the load cam and follower, and the forces on such load cam to deactuate the pressure loading control mechanism.

Further in accordance with this invention, a low tolerance switch 60 (see FIG. 1) is employed to provide the function of producing appropriate signals for the logic and control unit LCU of the control mechanism 30 for controlling actuation/deactuation of the motor M. The switch also provides an appropriate signal to the logic and control unit if the motor M ever misses either side of the constant radius section 36*a* of the cam 36. The switch 60 is operated for example by a second cam 62, positioned to function with a specific angular orientation in relation to the load cam 36. The switch cam 62 exhibits tolerances relative to the load cam 36 that can be shown as angular tolerances explained in detail with reference to FIG. 4. Such tolerances cause a variable stopping position of the load cam 36. Further, the motor coast is another source of variability in the stopping position of the load cam. Together these tolerances have been found to exceed the guaranteed stopping of the load cam, relative to the follower 40, in the constant radius section 36*a*. As shown in FIG. 4, this may be accounted for, to assure proper stopping of the load cam relative to the follower in the constant radius section, by moving the switch cam 62 to an early stopping point and adding an adjustable delay before the motor M is shut off.

The switch 60 is also used to detect an error if the load cam 36 is not in the proper load position. The switch 60 has only two states; i.e., "on" or "off". It has been determined that when the follower 40 is on the rising portion of the load cam 36 and the motor M is "off", the cam 62 is rotated (with the load cam 36) to a point low enough that the switch 60 passes into the "off" state. The load cam 36 is configured such that the ramp is steep enough, and the force is high enough, to overcome inertia and friction and cause the cam to rotate. The switch cam 62 must then be arranged to be in the region where the load cam 36 will be driven down if it stops there. The movement generated by the follower 40 is determined by the tangent of the ramp, times the force of the follower. If this generated movement is greater than the total torque of the pressure loading control mechanism 30, the load cam 36 will rotate. Once this is determined, the switch 60 is placed at or above this location. This construction is also applied to the falling section of the load cam. With this in place, the switch 60 detects failures on either side of the constant radius portion 36*a* of the load cam 36.

If the load cam 36 does not rotate far enough such that the follower 40 reaches the constant radius section 36*a,* it will be driven back down past the switch actuation point and detected to generate an appropriate signal for the logic and control unit L. If the load cam 36 moves far enough so that the follower 40 overshoots the constant radius section 36*a* of the load cam, it will be driven down past the switch actuation point and an error signal will be generated. With the described arrangement, the constant radius section 36*a* is then selected to be larger than the motor coast without a brake. An additional cost savings is thus realized by eliminating the motor brake.

The invention has been described in detail with particular reference to certain preferred embodiment thereof, but it will be understood that variations and modifications can be effected within the spirit and scope of the invention.

What is claimed is:

1. A mechanism for applying pressure load force in a reproduction apparatus fuser device having at least one heated fuser member and a pressure member in nip relation to permanently fix a marking particle image to a receiver member, said pressure load force applying mechanism including a load cam selectively rotated about a drive shaft, said cam having a wide constant radius section to have a wide tolerance in the stopping position, a cam follower member associated with said load cam, wherein a force of said load cam is applied via said cam follower member, and a control mechanism for said load pressure applying mechanism, said control mechanism comprising a raised section at each end of the constant radius section of said load cam to act as stops for said follower.

2. The control mechanism according to claim 1 wherein said stops are selected to be sufficiently large to stop the movement of said follower relative to said load cam, yet small enough so that said load cam can be positively rotated to move said stops over said follower.

3. The control mechanism according to claim 2 further including a low tolerance switch for providing appropriate signals for controlling actuation/deactuation of positive rotation of said load cam.

4. The control mechanism according to claim 3 wherein said switch provides an appropriate signal if said follower stops relative to said load cam beyond said constant radius section of said load cam.

5. The control mechanism according to claim 4 wherein said switch is operated by a second cam positioned to function with a specific angular orientation in relation to said load cam, said second cam having tolerances relative to said load cam that can be defined in terms of angular tolerances.

6. The control mechanism according to claim 5 wherein said tolerances cause a variable stopping position of said load cam.

7. A mechanism for applying pressure load force in a reproduction apparatus fuser device having at least one heated fuser member and a pressure member in nip relation to permanently fix a marking particle image to a receiver member, said pressure load force applying mechanism including a load arm assembly rotatable about a fixed pivot axis to apply a pressure force to said pressure member, a load cam selectively rotated about a drive shaft, said cam having a wide constant radius section to have a wide tolerance in the stopping position, a cam follower member, associated with said load cam, wherein a force of said load cam is applied via said cam follower member to said load arm assembly, and a spring nest formed as a part of said load arm assembly, wherein said cam follower member, upon movement under the influence of said load cam, compresses said springs at different travel positions of said cam follower for varying the pressure force on said pressure, and a control mechanism for said load pressure applying mechanism, said control mechanism comprising a motor for selectively rotating said load cam, a logic and control unit for controlling actuation/deactuation of said motor, and a raised section at each end of the constant radius section of said load cam to act as stops for said follower if said follower, due to back pressure from said heavy and light springs, causes said load cam to repeatedly move slightly until it eventually encounters one of said stops.

8. The control mechanism according to claim 7 wherein said stops are selected to be sufficiently large to stop the movement of said follower relative to said load cam, yet small enough so that said load cam can be positively rotated by said motor to move said stops over said follower.

9. The control mechanism according to claim 8 further including a low tolerance switch for providing appropriate signals for controlling actuation/deactuation of said motor for positive rotation of said load cam.

10. The control mechanism according to claim 9 wherein said switch provides an appropriate signal if said follower stops relative to said load cam beyond said constant radius section of said load cam.

11. The control mechanism according to claim 10 wherein said switch is operated by a second cam positioned to function with a specific angular orientation in relation to said load cam, said second cam having tolerances relative to said load cam that can be defined in terms of angular tolerances.

12. The control mechanism according to claim 11 wherein said tolerances cause a variable stopping position of said load cam.

13. The control mechanism according to claim 12 wherein said load cam is driven backwards to an unactuated switch point if it does not reach a correct operating position, detected by a change in state of said switch during normal operation.

14. The control mechanism according to claim 7 wherein said constant radius section of said load cam is selected to be larger than the coast of said motor, without a brake, so as to eliminate the need for a brake for said motor.

* * * * *